US010569536B2

(12) United States Patent
Hettler et al.

(10) Patent No.: US 10,569,536 B2
(45) Date of Patent: Feb. 25, 2020

(54) METHOD AND DEVICE FOR CONTROLLING PRINTING ELEMENTS OF AN INK PRINT HEAD

(71) Applicant: Océ Holding B.V., Venlo (NL)

(72) Inventors: Wolfgang Hettler, Feldkirchen-Westerham (DE); Christian Maier, Feldkirchen-Westerham (DE); Josef Liebl, Markt Schwaben (DE)

(73) Assignee: Océ Holding B.V., Venlo (NL)

( * ) Notice: Subject to any disclaimer, the term of this patent is extended or adjusted under 35 U.S.C. 154(b) by 10 days.

(21) Appl. No.: 16/058,212

(22) Filed: Aug. 8, 2018

(65) Prior Publication Data

US 2019/0047284 A1 Feb. 14, 2019

(30) Foreign Application Priority Data

Aug. 10, 2017 (DE) ..... 10 2017 118 258

(51) Int. Cl.

*B41J 29/38* (2006.01)
*B41J 2/045* (2006.01)
*B41J 2/165* (2006.01)

(52) U.S. Cl.

CPC ..... *B41J 2/04573* (2013.01); *B41J 2/04581* (2013.01); *B41J 2/04588* (2013.01); *B41J 2/04596* (2013.01); *B41J 2/165* (2013.01); *B41J 2/16585* (2013.01); *B41J 2002/16573* (2013.01)

(58) Field of Classification Search

None

See application file for complete search history.

(56) References Cited

U.S. PATENT DOCUMENTS

| | | | |
|---|---|---|---|
| 6,471,316 | B1 | 10/2002 | Seto |
| 9,044,937 | B2 | 6/2015 | Buschmann |
| 9,120,306 | B2 | 9/2015 | Buschmann |
| 9,205,645 | B2 | 12/2015 | Koerner |
| 9,302,474 | B2 | 4/2016 | Koerner et al. |

FOREIGN PATENT DOCUMENTS

| | | | |
|---|---|---|---|
| DE | 102012107775 | A1 | 2/2014 |
| DE | 102012110187 | A1 | 4/2014 |
| DE | 102014101428 | A1 | 8/2015 |
| DE | 102014106424 | A1 | 11/2015 |

*Primary Examiner* — Matthew Luu
*Assistant Examiner* — Tracey M McMillion
(74) *Attorney, Agent, or Firm* — Schiff Hardin LLP

(57) ABSTRACT

In a method for controlling printing elements of an ink print head, an idle time between the ejection of two dots from the same nozzle is determined. In the event that the idle time exceeds a predetermined threshold ($\Delta t_S$), a determined number of vibration cycles is performed (e.g. in immediate succession). The number of vibration cycles is determined based on the idle time, such that more vibration cycles are performed the longer that the idle time lasts between the ejections of two dots from the same nozzle.

18 Claims, 4 Drawing Sheets

METHOD AND DEVICE FOR CONTROLLING PRINTING ELEMENTS OF AN INK PRINT HEAD

CROSS REFERENCE TO RELATED APPLICATIONS

This patent application claims priority to German Patent Application No. 102017118258.6, filed Aug. 10, 2017, which is incorporated herein by reference in its entirety.

BACKGROUND

The disclosure relates to a method for controlling printing elements of an ink print head in a printing operation of an ink printing apparatus.

Ink printing apparatuses may be used for single-color or multicolor printing to a recording medium. The design of such an ink printing apparatus are described in DE 10 2014 106 424 A1 (U.S. Pat. No. 9,302,474 B2), for example. Such an ink printing apparatus has at least one print group having at least one print bar per print color. The print bar is arranged transversal to the transport direction of the recording medium and may have multiple print heads that possess a plurality of printing elements with nozzles in order to eject ink droplets from the nozzles. Each dot of a print line transversal to the printing direction is respectively printed by a different nozzle. The recording medium moves relative to the print bar. The nozzles thus print ink droplets in chronological succession in the longitudinal direction onto the recording medium. The higher the print resolution transversal to the transport direction of the recording medium, the more nozzles that are arranged in the print bars or the print head, or the closer (transversal to the transport direction) that the nozzles are arranged relative to one another.

During printing operation, the viscosity of the ink within a nozzle may not rise too severely, since otherwise there is the danger of the ink drying at the surface or drying out, such that the nozzle at least partially clogs and therefore an ink droplet may no longer be cleanly ejected, and/or its desired ejection direction is altered due to obstructing ink residues, such that the ink droplets are printed at a pixel or printing position that deviates from the desired position.

If the ink printing apparatus is in normal printing operation, an ink droplet is ejected again and again from the nozzles. As a result of this, the ink in the ink chamber and the nozzle channel refreshes. The danger of drying up is low in this state.

In a method for controlling vibrations in printing operation of the ink printing apparatus, multiple vibration cycles are inserted between two ejected ink droplets in the event that no ink droplets have been ejected from a nozzle for the length of a specific duration. The information about the activities and inactivity of nozzles are known from the print data that are supplied by the controller to the printer control.

During a vibration cycle, the actuator is activated with a predetermined waveform so that the ink meniscus at the output of the nozzle is set into vibration without ejecting an ink droplet. Via the vibration, the ink at the end of the nozzle channel is mixed so that ink with higher viscosity (having contact with the air) is mixed with fresh ink of lower viscosity from the ink chamber or the inside of the nozzle channel. In comparison to continuous printing without vibrations, the viscosity thus does not increase as quickly, and the danger of a clogging of the nozzle beginning is reduced.

In multiple ink printing apparatuses (DE 10 2014 101 428 A1=U.S. Pat. No. 9,205,645 B2, DE 10 2012 110 187 A1=U.S. Pat. No. 9,120,306 B2, and DE 10 2012 107 775 A1=U.S. Pat. No. 9,044,937 B2), meniscus vibrations are implemented depending on the size of the ejected ink droplets, depending on the velocity in delay ramps or acceleration ramps in the printing, depending on the printing pause etc. It is common to these ink printing apparatuses that multiple vibration cycles are performed in succession. The beginning of the first vibration cycle is established by the duration since ink droplets are no longer ejected from a nozzle. A constant number of vibration cycles is conventionally implemented. However, it may occur that, for some inks, the number of vibration cycles is too high, whereby a leaking of ink onto the nozzle plate can be observed.

For other inks (inks with different chemical/physical properties), the predetermined number of vibration cycles may be too low, such that the refresh effect is not sufficient and drying-out effects may occur, which is noticeable in the print image as what is known as a "first line effect" (meaning that dots printed with the first print line have a somewhat different appearance than the subsequent dots). Given use of various inks with different drying behavior, problems with degraded viscosity definitely may occur in the nozzles channels given one or another ink.

A method for controlling printing elements of an ink print head to eject ink droplets is described in U.S. Pat. No. 6,471,316 B1. This method is based on the object to control a print head such that the activation duration is as short as possible, which should lead to an increase in the print speed. For this, a "drive signal" and a "preliminary drive signal" are controlled, matched to one another, so that the droplet generation may already be started if the ink meniscus is still settling. The phases of the oscillation that were generated by the "drive signal" or the "preliminary drive signal" thereby must be generated in a predetermined phase position relative to one another so that the still-existent and decaying vibration does not interfere with the generation of the ink droplet; rather, the decaying oscillation is "in phase" with the next oscillation to generate an ink droplet. The two signals should be matched to one another. For this, a vibration status of the decaying oscillation is determined.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 4A:
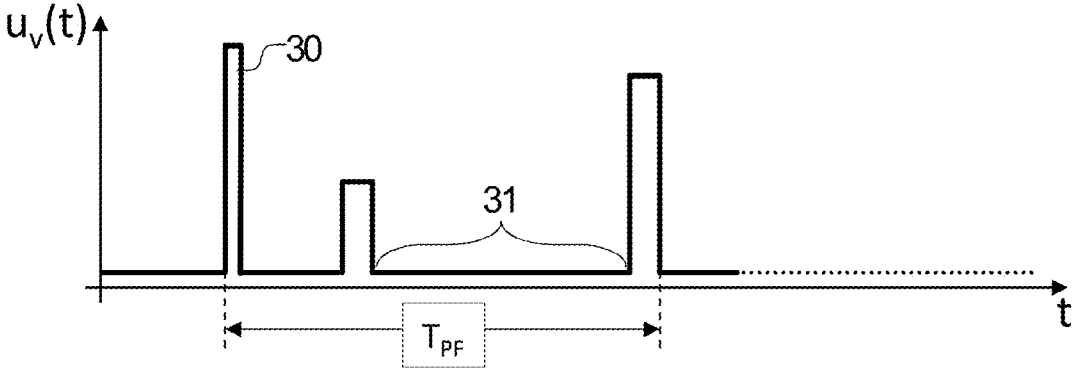
FIG. 4A illustrates a vibration waveform according to an exemplary embodiment of the present disclosure.
Figure 4B:
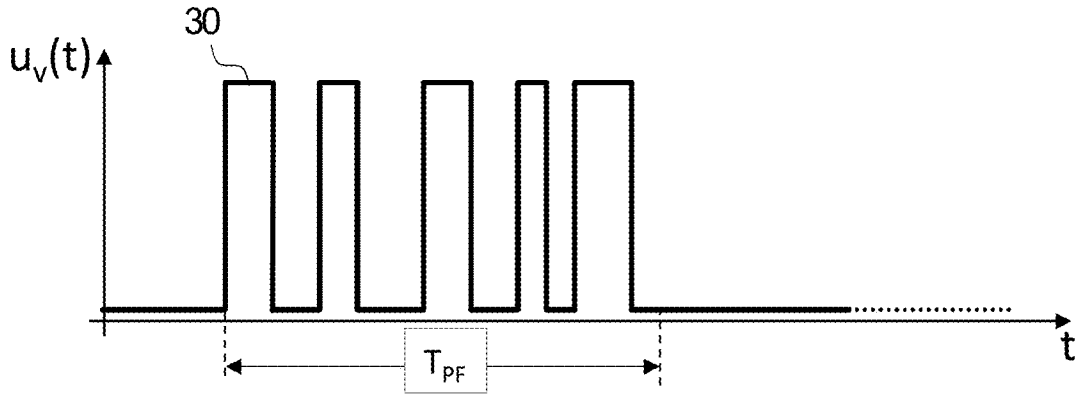

FIG. 4B illustrates a vibration waveform according to an exemplary embodiment of the present disclosure The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the disclosure is to provide a method for controlling printing elements of an ink print head, via which method the danger of ink drying out at nozzle outputs of the print head is reduced, and ink droplets are ejected from the nozzles largely with the desired size and the correct direction, even if various inks having different drying behavior are used.

In an exemplary embodiment, in printing operation of an ink printing apparatus, actuators of printing elements of an ink print head are thereby respectively controlled with pulse-shaped signals in order to set the ink into oscillation and eject ink droplets. In order to prevent the clogging of nozzles given longer inactivity, the ink is set into oscillation without ejecting an ink droplet. For this, a duration between the last ejection of an ink droplet from a nozzle and the intended next ejection of an ink droplet from the same nozzle is determined and compared with a predetermined threshold. If the determined duration exceeds the threshold, corresponding actuators are controlled in order to perform a defined number of vibration cycles, whereby vibrations of the ink meniscus are performed at a nozzle output associated with the respective actuator, without ejecting an ink droplet. The number of vibration cycles to be performed is determined depending on the determined duration between the last ejected ink droplet and the next ink droplet to be ejected.

In an exemplary embodiment, the number of vibration cycles to be set may additionally be determined depending on the drying properties of the ink used. The longer the inactive duration, the greater the number of vibration cycles. The threshold and the number of vibration cycles are indirectly dependent on drying properties of the ink. A point in time for the last vibration cycle of the number of vibration cycles may advantageously be determined so that an oscillation generated by the vibration cycles may decay within a predetermined decay time period before the next ink droplet is printed. The oscillation of the ink as a result of the vibration cycles thus comes to a rest before an ink droplet is ejected again.

Figure 1:
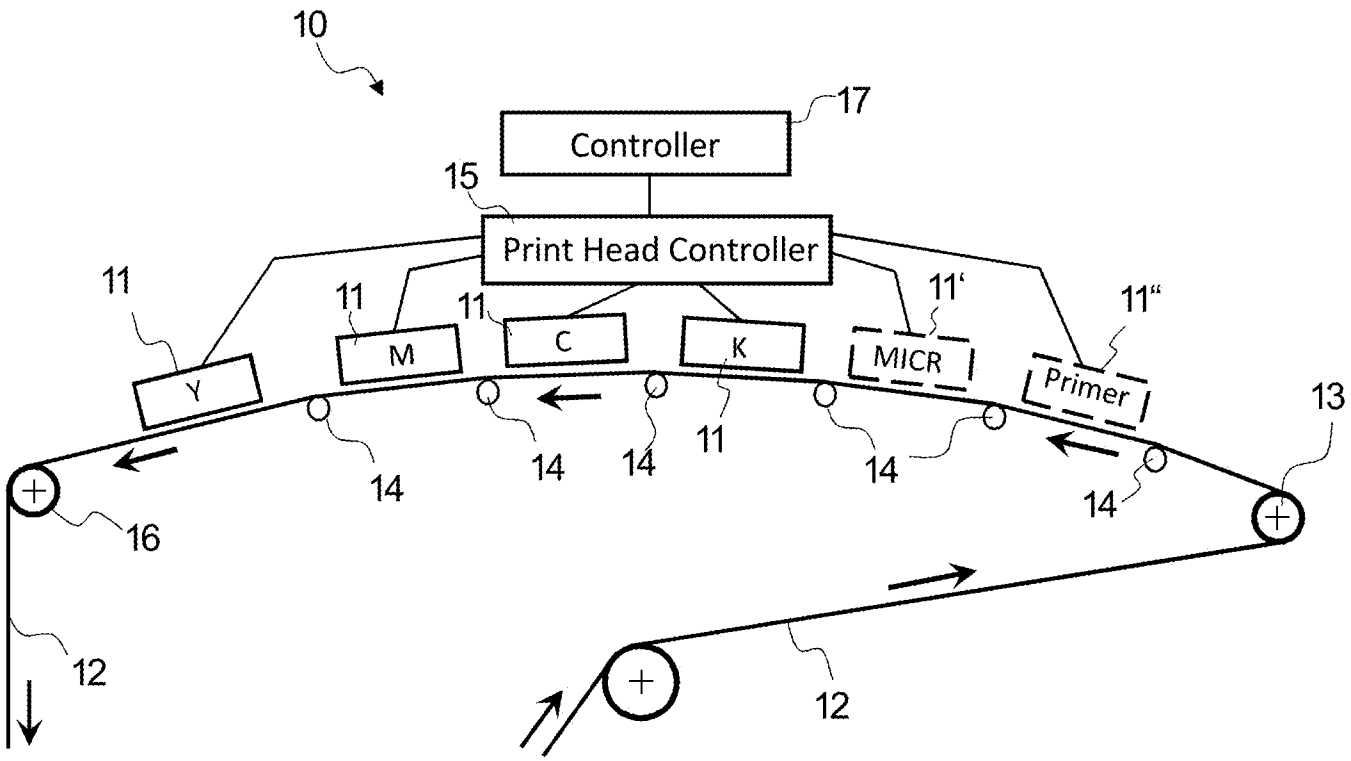
Figure 1 (Related Art)
FIG. 1 illustrates a conventional ink print group.

Presented in FIG. 1 is a print group 10 of a conventional ink printing apparatus. An example of the ink printing apparatus is described in German Patent Application No. DE 10 2014 106 424 A1, or its U.S. equivalent (U.S. Pat. No. 9,302,474 B2). These applications are each incorporated herein by reference in their entirety. Such a print group 10 has at least one print bar 11 per color, with one or more print heads that are arranged transversal to the transport direction (represented by corresponding arrows in FIG. 1) of a recording medium 12. Transversal to the printing direction, a printing element is associated with each dot of a print line such that the continuously moving recording medium 12 may be printed in with the desired fluids (inks/colors) in a line clock pulse and with a corresponding resolution.

Four primary colors are typically necessary for color printing, and in fact YMCK (yellow, magenta, cyan, and black=K) or RGB (red, green, blue). Moreover, additional customer-specific colors or special inks may be present, such as MICR ink (Magnetic Ink Character Recognition=magnetically readable ink). All colors/inks are then respectively printed with a separate print bar 11, 11'. It is likewise possible that transparent special fluids, such as primers or drying promoters, are likewise digitally applied with a separate print bar 11" before or after the printing of the print image in order to print the print quality or the adhesion of the ink onto the recording medium 12.

Each fluid/ink is printed with at least one print bar 11, 11', or 11". Printing may thereby take place across the width of a line with a print bar 11. Each dot along a line is printed by a separate printing element 20 (see FIG. 2). Given a printing width of 20 inches and a print resolution of 600 dpi, for example, 12000 printing elements are present in one print bar, which may accordingly print 12000 dots per print line. The print resolution in the print line direction (transversal to the transport direction) is determined by the clearances of the printing elements 20 relative to one another. By contrast, the print resolution in the transport direction is determined by the transport velocity and the line timing of the print heads in line-clocked printing.

Via an infeed roller 13 and multiple deflection rollers 14, a recording medium 12 in the form of a web is directed below the print bars 11 with the printing elements 20. The individual printing elements 20 are activated via a print head controller 15 with corresponding control signals according to the desired image data. The image data are transferred from a host (not shown) to a controller 17, which prepares the entirety of the print information for printing and relays said information to the respective print head controller 15 of each print bar 11. In an exemplary embodiment, each print bar 11 has a respective print head controller 15. In an aspect, two or more print bars 11 can share a common print head controller 15. In an exemplary embodiment, the print head controller 15 and/or the controller 17 include processor circuitry that is configured to perform one or more respective functions and/or operations of the print head controller 15 and controller 17.

The recording medium 12 is directed through the print group 10, and the printing elements 20 are thereby controlled line by line in the print line timing pulse, corresponding to the desired print image, so that the individual ink droplets may respectively be printed exactly at the desired image position on the recording medium 12. With a takeoff roller 16, the recording medium 12 is further directed to a drying (not shown) and possibly to a subsequent print group in which the back side of the recording medium 12 may be printed to. The recording medium 12 may subsequently be supplied to a post-processing in which the recording medium 12 is cut, folded, or finished in other work steps.

Figure 2:
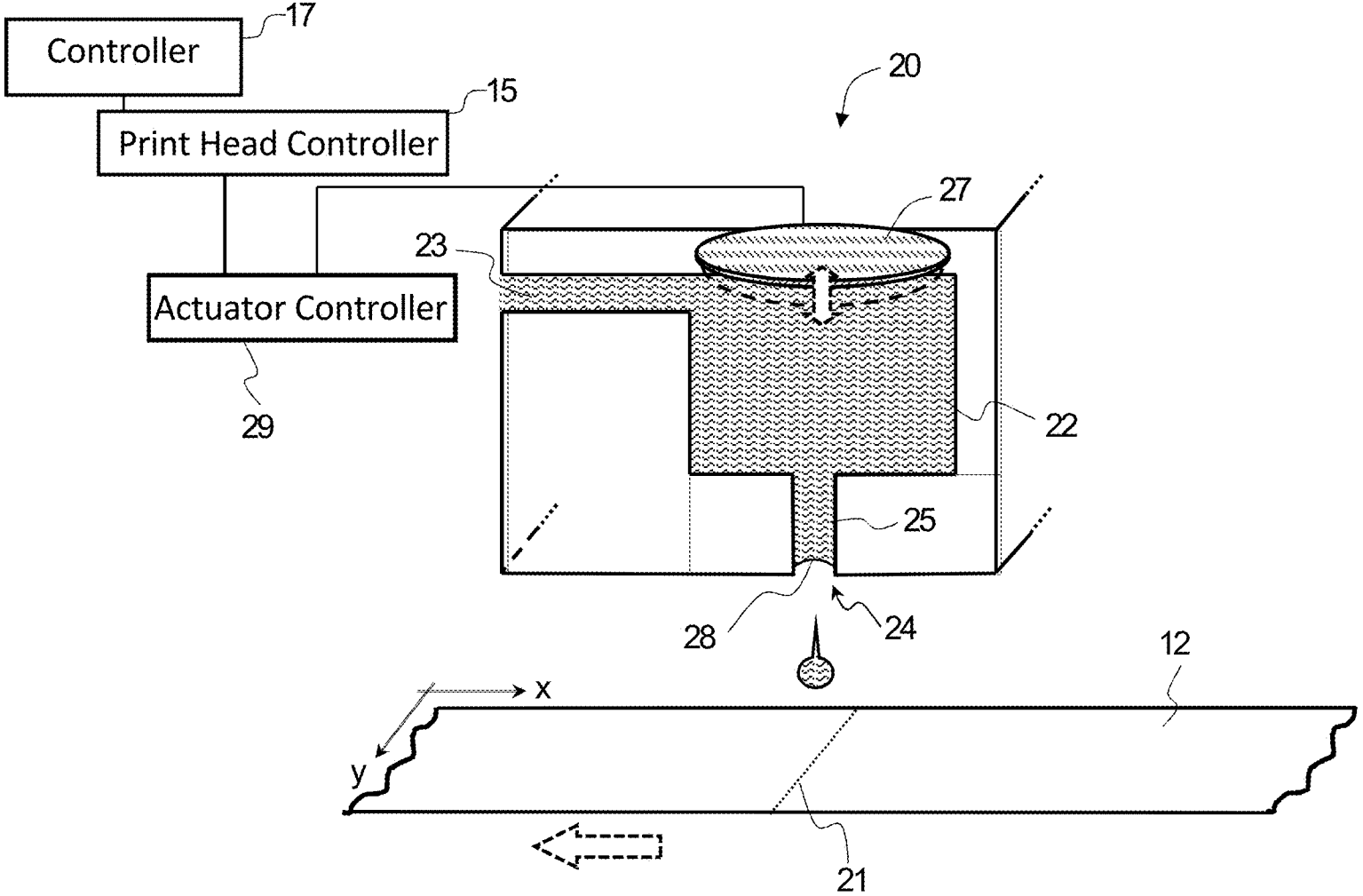
FIG. 2 illustrates a cross-sectional presentation of a printing element of an ink print group according to an exemplary embodiment of the present disclosure.

A single printing element 20, according to an exemplary embodiment, of a print head is depicted in FIG. 2. The printing element 20 has an ink chamber 22 that is filled or refilled with fresh ink via an ink supply 23. An ink droplet may be ejected via a nozzle 24 with a nozzle channel 25. To generate an ink droplet, an actuator 27 is arranged in the ink chamber 22 or in the nozzle channel 25. The actuator 27 is activated with a pulse-shaped control signal by an actuator controller 29 depending on the print data that arrive from the controller 17 via the print head controller 15. The control signal has a predetermined waveform having one or more pulses. The actuator 27 is activated by the control signal so that the ink in the ink chamber 22 is set into oscillation under corresponding mechanical pressure. In an exemplary embodiment, the actuator controller 29 includes processor circuitry that is configured to a generate a pulse-shaped control signal based on the print data, and to provide the pulse-shaped control signal to the actuator 27 to activate the actuator 27.

In an exemplary embodiment, a piezoelement is used as an actuator 27. If a piezoelement is used as an actuator 27, the piezoelement expands (see double arrow and dashed line in FIG. 2) as soon as it is activated accordingly, and thereby sets the ink in the ink chamber 22, and in particular in the nozzle channel 25, into oscillation corresponding to the waveform.

In an exemplary embodiment, the control signal has a complex waveform that ensures that the actuator 27 briefly expands and contracts again multiple times. Via this changing placement of the ink under negative pressure/positive pressure, said ink is set into a corresponding oscillation, as a result of which ink droplets may be pressed out of the nozzle 24. Depending on the waveform (frequencies, amplitudes, rise or fall times of the pulses, pulse/pause ratios, signal energy etc.), the ink droplets may be ejected from the nozzle 24 with different size or speed, or only vibrations of the ink meniscus 28 that correspond to waveform may be produced at the output of the nozzle channel 25, without an ink droplet being ejected.

In printing mode, the ink printing apparatus may be operated at a constant speed of 100 m/min, for example, for a recording medium 12 in the form of a web. For this, the recording medium 12 is directed in the arrow direction (see dashed-line arrow; opposite the x-direction) through the print group 10, past the print bars 11. The plurality of printing elements 20 is arranged transversal to the transport direction. As soon as the recording medium 12 has moved further by a predetermined distance, the printing elements 20 are activated according to the image data. The distance thereby corresponds to the resolution in the transport direction and is also defined as a print line width (or pixel width). The printing elements are thus controlled in a print line timing pulse, such that print lines 21 (y-direction) may be printed in succession at the same pixel pitch, print line 21 by print line 21, according to the desired image data. The corresponding ink droplets thus respectively arrive, according to the line timing pulses, exactly at the desired image position on the recording medium 12.

Only given a monochromatic, full-area print image across the entire printing area of a side, are ink droplets continuously ejected from all nozzles of the corresponding print bar 11. However, the degree of coverage of ink on one side is for the most part distinctly below this, primarily if a great deal of text is used for the print image. In such an instance, the degree of coverage is between 10% and 20% for only one color ink, for example. All printing elements 20 are thus not always active in order to eject an ink droplet. In particular, in the margin region the associated printing elements 20 may be inactive for a longer amount of time, since often no print image is printed there.

If no ink droplet is ejected from a nozzle 24 for a specific length of time, the danger exists that the ink in the nozzle 24 dries up. Ink has special chemical components so that the ink does not dry up in a sealed space, but by contrast dries rapidly on the recording medium 12. The viscosity of the ink increases due to the contact with air at the output of the nozzle 24, and the ink tends to dry out.

The oscillation behavior of the ink in the nozzle channel 25 alters with the increase in the viscosity, to the point of a standstill in the event that the nozzle 24 is completely sealed by dried ink, which corresponds to a total failure of the nozzle 24. This is then apparent in a degraded print quality. Total failure of a nozzle 24 is visible in the print image as light stripes in an area that is otherwise printed over its entirety. A partial clogging of the nozzle 24 likewise becomes apparent as a streaking, since only smaller ink droplets can be ejected (lower intensity) and/or the ejection direction is skewed, which undesirably leads to an altered image position. It is necessary to prevent the drying up of the ink in the print head, since otherwise every print head would need to be cleaned in a costly manner before it may be printed with again.

For this reason, certain measures are necessary that enable an optimally flawless printing of a print image. Here it is not an interruption of the printing operation, in which the heads must be moved into a maintenance position and be expensively cleaned there, that is thereby considered, but rather only the vibration of the ink meniscus 28 at the output of the nozzle 24. In the following, the vibration of the in meniscus 28 that is triggered by a predetermined waveform is designated as a vibration cycle or prefire. The waveform that is used is matched to the ink that is used so that the prefire is also implemented optimally and effectively.

In an exemplary aspect, each prefire occurs a predetermined, constant number of times in immediate succession while the nozzle is inactive (this duration of inactivity in the x-direction is referred to in the following as idle time $\Delta t_{Ty}$).

Multiple vibration cycles are then triggered in a printing element 20 as soon as it is anticipated that a predetermined time length (idle time $\Delta t_{Ty}$) will pass without an ink droplet being ejected from its nozzle 24. Via the generated oscillation in the nozzle channel 25, the ink at the ink meniscus 28 is mixed with ink in the nozzle channel 25 and the viscosity at the output of the nozzle 24 decreases. The danger of the nozzles 24 drying out is thus reduced.

All points in time of ejection of ink droplets from each nozzle 24, and the idle times $\Delta t_{Ty}$ without an ink droplet being ejected, are determined in advance in the controller 17 and relayed to the print head controller 15. Within a certain time window across numerous print lines, it is thus known which printing elements 20 have already last ejected ink droplets or will eject ink droplets, and when they will eject ink droplets again in the future after the idle time $\Delta t_{Ty}$. The individual idle times $\Delta t_{Ty}$ of each printing element 20 are determined by the controller 17 and delivered to the print head controller 15. The individual idle times $\Delta t_{Ty}$ are thus likewise known in advance.

The print head controller 15 activates the respective actuators 27 to eject an ink droplet or to generate vibrations in the print line timing pulse. In addition to this, a threshold $\Delta t_S$ is stored in a memory of a controller (controller 17 and/or print head controller 15). If the idle time $\Delta t_{Ty}$ for a nozzle 24 should be greater than the threshold idle time $\Delta t_S$, vibration cycles are performed during the idle time $\Delta t_{Ty}$ between the last ejection of an ink droplet and the future next ejection of an ink droplet.

In an exemplary embodiment, in the controller 17, the entirety of the image data for the printing of the entire print job is prepared bit by bit. The comparison of the idle times $\Delta t_{Ty}$ with the thresholds $\Delta t_S$ may also occur there. The ejection points in time are thus known for each printing element 20 (both for the past and after calculation for the future). It is thus also known when the printing element 20 will next eject an ink droplet again. These data may also be transferred to the print head controller 15 so that the determination of the vibration cycles may occur there. Vibration cycles may thus then accordingly be started promptly, or may also already be promptly initiated.

Figure 3:
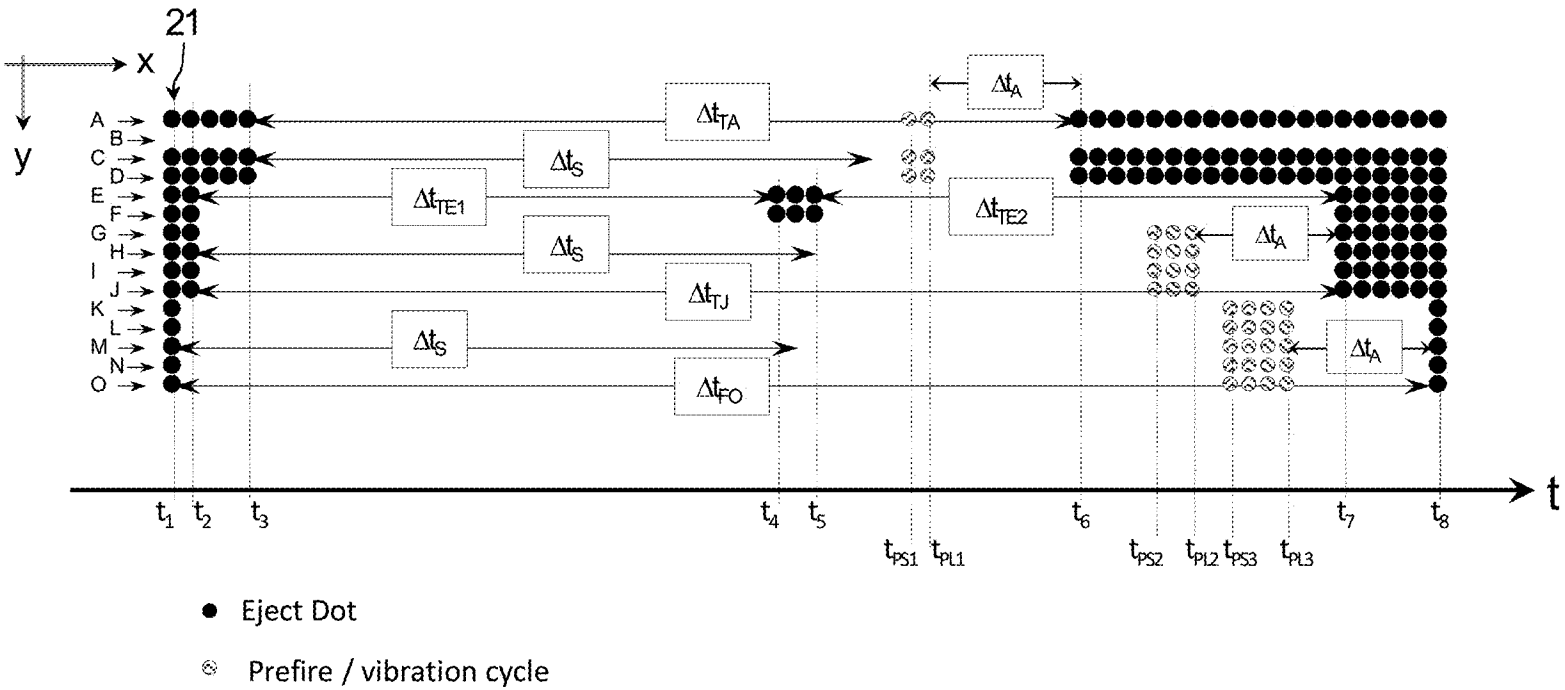
FIG. 3 illustrates a chronological presentation of a print image with associated vibration cycles according to an exemplary embodiment of the present disclosure.

A method according to an exemplary embodiment of the disclosure for controlling printing elements of an ink print head is explained in detail using FIG. 3. There, the ejection points in time of a print line 21 (y-direction) are presented over time t (x-direction). The print lines 21 are arranged in a column grid corresponding to the print line width. Of a whole print line 21, here only 14 print column positions (A to O) are shown in which corresponding dots may respectively be printed by 15 printing elements. Given a total print width for the recording medium 12, for example of 20 inches, and a print resolution of 600 dpi, in total 12000 printing elements are present in a print bar which may accordingly print a respective dot per print line 21 in 12000 print columns.

An individual ejected ink droplet that leads to a dot is represented in FIG. 3 by a solid black circle at the respective point in time $t_x$, whereas prefire is represented by a wavy marked cross at the respective point in time $t_{Px}$. In the event that a dot should be composed of multiple ink droplets, the present description representatively applies to the entire dot (pixel) instead of to the individual ink droplets.

The future ejection points in time $t_x$ and the respective idle times $\Delta t_{Ty}$ (duration during which no ink droplets are ejected from the respective nozzle) are initially delivered by the controller 17 to the print head controller 15. The print head controller 15 thus knows when ink droplets are to be ejected corresponding to the print data, and during which duration (idle time $\Delta t_{Ty}$) no ink droplets should be ejected within a print column.

In an exemplary embodiment, it is first determined whether no ink droplet is respectively ejected in a print column A to O for the length of an idle time $\Delta t_{Ty}$, and whether the idle time $\Delta t_{Ty}$ will be longer than a predetermined threshold $\Delta t_S$. If (it is anticipated that) this will be the case, it is provided that vibration cycles are to be performed a number of times in immediate succession in this print column so that that the danger of a surface drying or drying out of the ink in the associated nozzle 24 is reduced.

In an exemplary embodiment, the vibration cycles may not occur simultaneously with the ejections of ink droplets. Therefore, the vibration cycles are performed multiple times (predetermined number) within the time interval of the idle time $\Delta t_{Ty}$. The vibration cycles are advantageously placed in time within the idle time $\Delta t_{Ty}$ so that the last vibration cycle is performed at a predetermined decay duration $\Delta t_A$ before the next ejection point in time $t_x$. The vibration oscillations of the ink in the nozzle 24 may thus entirely decay before the next ink droplet is generated and ejected in the same nozzle 24.

In an exemplary embodiment, the vibration cycles occur in the same line timing pulse as the ejection of ink droplets. The number of vibration cycles depends on the duration of the idle time $\Delta t_{Ty}$ insofar as the idle time $\Delta t_S$ exceeds the threshold $\Delta t_S$ at all. Since the idle time $\Delta t_{Ty}$ is already known in advance from the controller 17, and it is also known whether the idle time $\Delta t_{Ty}$ exceeds the threshold $\Delta t_{Ty}$, the number of vibration cycles may be determined depending on the length of the idle time $\Delta t_{Ty}$. The last vibration cycle should be ended corresponding to the decay duration $\Delta t_A$ before the next ejection of an ink droplet. The starting point in time $t_{PSx}$ for the starting of the number of vibration cycles may thus be simply determined from the number and the point in time $t_{PLx}$ for the last vibration cycle.

In the exemplary embodiment according to FIG. 3, for the sake of a better explanation, the number of vibration cycles and the time intervals are presented in a simplified manner and no in absolute values.

In the print columns A, C and D, the respective last ink droplet for now is ejected at the point in time $t_3$. The next ejection of an ink droplet will first take place at the point in time $t_6$. This is already known in advance by the controller 17. Since the idle time $\Delta t_{TA}$ in the print column A lasts longer than the threshold $\Delta t_S$, a number of vibration cycles is started between the two ejection points in time $t_3$ and $t_6$ of the last or next ink droplet. The number of vibration cycles to be performed is dependent on the duration of the idle time $\Delta t_{TA}$, which here is relatively short since the $\Delta t_{TA}$ in the presented exemplary embodiment for the print columns A, C and D is only slightly longer than the threshold $\Delta t_S$.

Here only two vibration cycles are shown. The last vibration cycle should advantageously be ended at the point in time $t_{PL1}$ so that the vibration oscillation may come to rest during the following decay duration $\Delta t_A$ before the point in time $t_6$ of the next ejection of an ink droplet. The starting point in time for the first vibration cycle thus results at the point in time $t_{PS1}$. Vibration cycles may thus occur corresponding to the calculated number of times, wherein the number is determined at least depending on the duration of the idle time $\Delta t_{TA}$. Since this has already been determined in advance, the printing elements 20 of the print columns A, C and D are accordingly promptly controlled as soon as the recording medium 12 has progressed by line timing pulses corresponding to the respective points in time.

In the present exemplary embodiment, here no ink droplets have been ejected by the printing element 20 in the print column B. Therefore, no prefire is performed here either.

In the print columns E and F, a respective ink droplet is ejected for the last time, for now, at the point in time $t_2$. Ink droplets are then ejected again between the points in time $t_4$ and $t_5$, and subsequently are only ejected again as of the point in time $t_7$. Since the idle times $\Delta t_{F1}$ and $\Delta t_{F2}$ are respectively shorter than the threshold $\Delta t_S$, no prefire occurs in these two print columns E and F.

In the print columns G, H, I and J, a respective ejection of an ink droplet occurs for the last time, for now, at the points in time $t_2$ and again as of the point in time $t_7$. Since the respective idle time $\Delta t_{TJ}$ exceeds the threshold $\Delta t_S$, multiple prefires are respectively performed during the inactivity of the nozzles 24 in the printing elements that are associated with the print columns G, H, I and J. Here, the number of vibration cycles should be greater than in print columns A, C and D, since the idle time $\Delta t_{TJ}$ respectively lasts longer than the idle time $\Delta t_{TA}$. Here, three vibration cycles are performed that should be started at the point in time $t_{PS2}$ so that they may be ended at the point in time $t_{PL2}$. The oscillations of the ink in the nozzle channel 25 thus may decay to the rest state during the decay time $\Delta t_A$.

In the print columns K, L, M, N and O, a respective ejection of ink droplets respectively occurs at the point in time $t_1$ and again as of the point in time $t_8$. The idle time $\Delta t_{TO}$ markedly exceeds the threshold $\Delta t_S$, and this inactive state lasts longer than the other idle times $\Delta t_{TJ}$ and $\Delta t_{TA}$. Therefore, the number of vibration cycles is greatest in the print columns K, L, M, N and O, and in fact here is shown to be four times greater.

For the sake of clarity, only a few vibration cycles/prefires are depicted in FIG. 3. For example, given preliminary tests with a special water-based pigment ink, the following minimum values have resulted for the number of vibration cycles, and in fact as 20 for black, 30 for yellow, 80 for magenta and 130 for cyan.

Starting from these values (number of vibration cycles), the number of vibration cycles increases the longer the respective idle time $\Delta t_{Ty}$ lasts, up to a predetermined maximum value of vibration cycles.

The threshold $\Delta t_S$ for a special ink may, for example, be 400 print line timing pulses long. As of this value, it is assumed that vibration cycles need to be performed so that the print quality does not change as a result of the viscosity change at the output of the nozzle 24. For example, the decay duration $\Delta t_A$ may be 50 print line timing pulses long given a special ink. It is assumed of this (verified via tests) that the oscillation in the nozzle channel has safely decayed to a rest state within the decay duration $\Delta t_A$ after a vibration cycle, before an ink droplet is ejected again from the same nozzle 24 without negative effect due to the preceding vibration oscillations.

The minimum values for the number are determined by the drying properties of the ink. Given a quick-drying ink, the minimum value may also be greater than in the indicated example, and given a very slow-drying ink it may also be smaller than in the example.

The number of vibration cycles may not become too large because the ink would be too severely stressed and would result in a leaking from the nozzle 24. Therefore, for each ink there is an upper limit (maximum value) for the number of vibration cycles. The number also may not be too small (minimum value) so that the ink also is still effectively mixed thoroughly upon vibration and the viscosity does not rise too quickly. The danger of a surface drying or drying up of the ink in the nozzle 24 is thus counteracted.

At most, a determined number of vibration cycles in immediate succession occurs once between two ejected dots and within the idle time $\Delta t_{Ty}$ (in the event that the idle time $\Delta t_{Ty}$ exceeds the threshold $\Delta t_S$), wherein the number is determined depending on the duration of the idle time $\Delta t_{Ty}$. If no dot is printed in a print column, no prefire occurs as well.

In an exemplary embodiment, the control signals for the ejection of ink droplets or for the vibration of the meniscus are always matched to the ink printing apparatus, the print heads, and most of all the ink that is used.

In an exemplary embodiment, the optimal number of vibration cycles for the respective ink is found in advance via testing. Starting from a predetermined configuration (hardware used, corresponding ink with its drying properties, and print heads adapted to the ink), the number of vibration cycles is varied systematically and test images are printed in part in long-term testing. The results are then evaluated, and the best print image is sought.

Its associated number of vibration cycles is then stored in the controller 17 (e.g. in an internal memory of the controller 17) and/or in the print head controller 15 (e.g. in an internal memory of the print head controller 15). In an exemplary embodiment, the number of vibration cycles are stored additionally or alternatively in a memory external to the controller 17 and/or print head controller 15, such as a memory included in the print group 10 or external to the print group 10.

If a different ink is used in a print bar 11, new tests must occur in order to establish the threshold $\Delta t_S$, the decay duration $\Delta t_A$, and the corresponding minimum number. For example, if a multicolor ink printing apparatus is used, the minimum values for the number of vibration cycles, for the decay duration $\Delta t_A$, and for the threshold $\Delta t_S$ are separately matched to each ink. The values may additionally be varied depending on the components used in the inks.

The threshold $\Delta t_S$ is accordingly predetermined so that it is known as of what duration of the absence of ejection of an ink droplet a degradation of the print image becomes noticeable. This duration, or for safety's sake a somewhat shorter duration, is then stored as a threshold $\Delta t_S$ in the print head controller 15. The idle time $\Delta t_{Ty}$ of an inactive nozzle 24, supplied by the controller 17, may then thus be compared with the threshold $\Delta t_S$. Insofar as the idle time $\Delta t_{Ty}$ is then greater than the threshold $\Delta t_S$, the vibration cycles are performed accordingly often.

In an exemplary embodiment, the number of vibration cycles is dependent on the duration of the idle time $\Delta t_{Ty}$ determined for the respective nozzle 24. The number of vibration cycles may additionally or indirectly be dependent on the drying properties of the ink used, the materials used in the print head (such as special coating of the nozzle channels 25), and/or on the energy content or the signal effectiveness with regard to the effect on the oscillation of the vibration signals $u_v(t)$ used for the vibration cycles (see FIGS. 4A and 4B). The duration of the idle time $\Delta t_{Ty}$ has the most influence. Since the other influencing variables may have a significantly smaller influence on the number of vibration cycles, it is sufficient to allow only the idle time $\Delta t_{Ty}$ to influence the number of vibration cycles. The other influencing variables may advantageously also be additionally taken into account in the determination of the number so that the precision is somewhat further increased. The respective influence of the influencing variables always applies only to a selected ink/print head combination.

The settings of the vibrations are tested in advance such that prefires are not performed too strongly or too often, and are not performed with too low an intensity or too rarely, and nevertheless the print image occurs largely without errors such as what are known as a first-line effect, "weeping" ink droplets in the region of the nozzle 24 on the nozzle plate, or missing nozzles effects (absence of dots along a strip=streaking).

If prefires are performed multiple times in direct succession, the viscosity does not increase as quickly relative to continuous printing without prefires, and the danger of a clogging of the starting is reduced.

In an exemplary embodiment, the vibrations may be formed by waveforms similar to those for the ejection of an ink droplet. The number of vibration cycles may additionally depend on the respective waveform that is to be used. In FIGS. 4A and 4B, respective different waveforms for prefires are shown according to exemplary embodiments that are designed differently depending on the energy requirement for the vibration. The respective waveform for a time-dependent vibration signal $u_v(t)$ is thereby shown for a respective single vibration cycle/prefire.

A low-energy vibration signal $u_v(t)$ according to an exemplary embodiment is presented in FIG. 4A. The waveform is characterized in that relatively few and relatively narrow pulses are present with regard to the signal duration $T_{PF}$ (which corresponds to the duration of the print timing pulse and the signal duration of the waveform for the ejection of an ink droplet). As a result of the low energy, this waveform leads only to a moderate vibration of the meniscus and to a low power consumption, as well as to less of a warming of the control electronics. If the prefire is controlled with such low-energy waveforms, the number of vibration cycles must be increased in order to achieve a good result with regard to the vibrations.

Depicted in FIG. 4B is a high-energy waveform according to an exemplary embodiment that leads to a very intensive vibration. The signal energy, the high/low ratio, and the pulse widths are respectively high/large. The necessary number of vibration cycles may additionally be reduced due to the more intensive/higher-energy prefire. The higher power consumption, and as a result of this an undesirable heating in the print head, has a disadvantageous effect.

As a result, the number of vibration cycles may additionally be correctively increased or reduced via use of a corresponding waveform, starting from the number that is determined via the duration of the idle time $\Delta t_{Ty}$.

The disclosure was described using an ink print head that uses piezoelectric actuators 27 in order to eject ink droplets, but is not limited thereto. For example, the disclosure may also be used in an ink print head that generates the ink droplets thermally (with heating element or laser) in that an air bubble is generated as a result of a heating action, which air bubble then presses an ink droplet out of the nozzle 24.

In addition to this, the disclosure was described using an ink print head that operates with a recording medium 12 in the form of a web. However, it is also possible to use recording media 12 in the form of pages or sheets. The disclosure is also independent of the material of the recording medium 12. Paper, paperboard, plastic films, metal foils, or mixed materials from these may also be printed to.

The ink printing apparatus may have two print groups 10, wherein the front side is printed in the first print group 10 and the back side is printed in the second print group 10 in the event that duplex printing is desired. Depending on the print group 10, a drying of ink on the recording medium 12 with subsequent cooling is provided so that the recording medium 12 may be supplied to the second print group 10 under the same conditions, or also may be processed accordingly in a post-processing (cutting, folding, creasing, stacking, application of varnish etc.), without liquid or damp ink being smeared, and thus without the print image being damaged or negatively affected.

During printing operation, the print heads are located very close to the recording medium 12, and remain there until the printing operation is ended and the print heads travel into a maintenance position in which the print heads are cleaned and covered with a cap for longer downtimes so that the ink in the nozzles does not dry out.

The ejection of ink droplets onto the recording medium 12, and the meniscus vibrations, occur only during the printing operation. Using the print data delivered by the controller 17, the print head controller 15 knows when and at which positions ink droplets should be ejected (this is also continuously calculated far in advance in the controller 17 across multiple pages), or also when the last ink droplet has been ejected—and that for each printing element 20 of a print line 21 and for each print bar 11.

In a method according to an exemplary embodiment, a corresponding actuator 27 of a printing element 20 is controlled such that it

- triggers the ejection of an ink droplet with corresponding size/volume according to the print data,
- performs a plurality of vibration cycles in immediate succession if a nozzle 24 has not been printed from for a longer period of time, and
- the number of vibration cycles is dependent on the duration of the non-ejection of an ink droplet from the same nozzle (idle time $\Delta t_{Ty}$).

In an exemplary embodiment, the vibration cycles are advantageously placed in time so that the number of vibration cycles have stopped in advance, by the decay duration $\Delta t_A$, of the next ejection of an ink droplet so that the oscillations of the ink in the printing element 20 may come to rest. The decay duration $\Delta t_A$ is dependent on the one hand on the properties of the ink used, and on the other hand on the vibration signal $u_v(t)$ itself with which the vibration cycles are generated. For example, the viscosity of the respective ink may play a decisive role in the oscillation behavior. The vibration signal $u_v(t)$, with which the ink in the ink chamber is set into vibration depending on how effectively the vibration oscillations are generated, may likewise also additionally play an influential role.

All determined and/or calculated values for the number, decay duration $\Delta t_A$, idle time $\Delta t_{Ty}$, threshold $\Delta t_S$ etc. always apply only to the specifically used combination of ink and print head. If a different ink or a different print head is used, the values must be re-determined. However, the ink or the print head is not changed during the printing operation.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others.

Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 print group
11 print bar
12 recording medium
13 infeed roller
14 deflection roller
15 print head controller
16 takeoff roller
17 controller
20 printing element
21 print line (in the y-direction)
A-O print column (in the x-direction)
2 ink chamber
23 ink supply
24 nozzle
25 nozzle channel
26 time measurement device
27 actuator
28 ink meniscus
29 actuator controller
30 pulse of the vibration signal
31 pulse pause of the vibration signal
$u_v(t)$ vibration signal
t time
$T_{PF}$ signal duration
$t_{PSx}$ point in time of the start of the vibration cycles
$t_{PLx}$ point in time of the end of the vibration cycles
$t_x$ point in time of the ejection of an ink droplet
$\Delta t_A$ decay duration
$\Delta t_S$ threshold
$\Delta t_{Ty}$ idle time in a print column y

The invention claimed is:

1. A method for controlling printing elements of an ink print head of an ink printing system has at least one print group with at least one print bar per print color, a print bar having at least one print head with a plurality of printing elements having a respective nozzle, the plurality of printing elements are respectively controlled by an associated actuator to eject ink droplets via these nozzles, the printing elements being arranged so that, across an entire printing width, a respective ink droplet per nozzle may be printed along a print line, transversal to the transport direction of a recording medium, the method comprising:

controlling corresponding printing elements to eject ink droplets as dots onto the recording medium, wherein the positions of the dots correspond to the desired image data;

determining of an idle time since a last ejection of an ink droplet from a nozzle of a printing element of the printing elements;

comparing the idle time with a predetermined threshold; and controlling the printing element to perform a number of vibration cycles between the last ejection of the ink droplet and a next ejection of an ink droplet, wherein vibrations of the ink meniscus are performed at an associated nozzle output of the nozzle without ejecting an ink droplet in the event that the idle time exceeds the threshold, wherein the number of vibration cycles to be performed is determined based on a length of the idle time between the last ejected ink droplet and the next ink droplet to be ejected from the nozzle, and wherein a point in time is determined for a last vibration cycle of the number of vibration cycles, such that an oscillation generated by the vibration cycles decays within a predetermined decay time period before the next ink droplet is printed.

2. The method according to claim 1, comprising activating the actuator with pulse-shaped signals to perform a respective vibration cycle.

3. The method according to claim 1, wherein the actuator is a piezoelectric actuator.

4. The method according to claim 2, wherein the actuator is a piezoelectric actuator.

5. The method according to claim 1, wherein the vibration cycles are performed in immediate succession in a print line timing pulse, corresponding to the number of vibration cycles to be performed, based on the length of the idle time between the last ejected ink droplet and the next ink droplet to be ejected from the nozzle.

6. The method according to claim 1, wherein the vibration cycles are performed based on the length of the idle time between the last ejected ink droplet and the next ink droplet to be ejected from the nozzle.

7. The method according to claim 1, wherein the decay time period and the predetermined threshold are respectively determined based on one or more characteristics of an ink used and one or more characteristics of the at least one print head.

8. The method according to claim 1, wherein the decay time period and the predetermined threshold are determined based on one or more characteristics of an ink used or one or more characteristics of the at least one print head.

9. The method according to claim 1, wherein the decay time period is determined based on one or more characteristics of an ink used or one or more characteristics of the at least one print head.

10. The method according to claim 1, wherein the decay time period is determined based on one or more characteristics of an ink used and one or more characteristics of the at least one print head.

11. The method according to claim 1, wherein the predetermined threshold is determined based on one or more characteristics of an ink used or one or more characteristics of the at least one print head.

12. The method according to claim 1, wherein the predetermined threshold is determined based on one or more characteristics of an ink used and one or more characteristics of the at least one print head.

13. A non-transitory computer-readable storage medium with an executable program stored thereon, when executed, causes a processor to perform the method of claim 1.

14. A controller comprising:

a memory; and a processor coupled to the memory and configured to perform the method of claim 1.

15. A device adapted to control printing elements of an ink print head of an ink printing system having at least one print group with at least one print bar per print color having at least one print head with a plurality of printing elements with a respective nozzle, the plurality of printing elements being respectively controlled by an associated actuator to eject ink droplets via these nozzles, and the plurality of printing elements being arranged so that, across an entire printing width, a respective ink droplet may be printed along a print line, transversal to the transport direction of a recording medium, the device comprising:

a memory that stores a predetermined threshold value; and a print head controller coupled to the memory, and that is configured to:

selectively activate corresponding actuators with a waveform to eject ink droplets as dots onto the recording medium, wherein positions of the dots correspond to image data, and control the corresponding actuators to perform a plurality of vibration cycles, wherein vibrations of an ink meniscus at a nozzle output respectively associated with the corresponding actuators are performed without ejecting a respective ink droplet, determine an idle time between a last ejection of an ink droplet from a nozzle of the nozzles and an intended next ejection of an ink droplet from the nozzle, compare the idle time with the predetermined threshold valve, activate the nozzle with a number of vibration cycles based on the comparison of idle time and the threshold value, and determine a point in time for a last of the vibration cycles so that an oscillation generated by the vibration cycles decays within a predetermined decay time period before a next ink droplet is printed.

16. The device according to claim 15, wherein the print head controller is configured to activate the nozzle with the number of vibration cycles in response to the idle time exceeding the threshold value.

17. A method for controlling printing elements of an ink print head including a plurality of printing elements having a respective nozzle, the method comprising:

determining of an idle time since a last ejection of an ink droplet of the ink from a printing element of the printing elements;

comparing the idle time with a threshold value;

determining a number of vibration cycles to be performed based on a duration of the idle time between the last ejected ink droplet and a next ink droplet to be ejected from the printing element;

perform the number of vibration cycles between the last ejection of the ink droplet and the next ink droplet based on the comparison, the number of vibration cycles corresponding to a duration of the idle time between the last ejected ink droplet and the next ink droplet to be ejected from the printing element, wherein the vibration cycles vibrate an ink meniscus associated with the printing element without ejecting one or more ink droplets; and determining a point in time for a last vibration cycle of the number of vibration cycles such that an oscillation generated by the vibration cycles decay within a predetermined decay time period before the next ink droplet is printed.

18. The method according to claim 17, wherein the number of vibration cycles are performed in response to the idle time exceeding the threshold value.

* * * * *